US010121399B2

(12) United States Patent
Lemons et al.

(10) Patent No.: US 10,121,399 B2
(45) Date of Patent: Nov. 6, 2018

(54) LCD SOURCE DRIVER FEEDBACK SYSTEM AND METHOD

(71) Applicant: American Panel Corporation, Alpharetta, GA (US)

(72) Inventors: Charles Lemons, Alpharetta, GA (US); David Williams, Alpharetta, GA (US); Gary Baek, Alpharetta, GA (US); Steve Preston, Alpharetta, GA (US)

( * ) Notice: Subject to any disclaimer, the term of this patent is extended or adjusted under 35 U.S.C. 154(b) by 866 days.

(21) Appl. No.: 14/227,578

(22) Filed: Mar. 27, 2014

(65) Prior Publication Data

US 2014/0312908 A1 Oct. 23, 2014

Related U.S. Application Data

(60) Provisional application No. 61/805,784, filed on Mar. 27, 2013.

(51) Int. Cl.

| | |
|---|---|
| ***G09G 3/00*** | (2006.01) |
| ***G09G 3/20*** | (2006.01) |
| *G09G 3/3275* | (2016.01) |
| *G09G 3/36* | (2006.01) |

(52) U.S. Cl.

CPC ..... *G09G 3/006* (2013.01); *G09G 3/20* (2013.01); *G09G 3/3275* (2013.01); *G09G 3/3685* (2013.01); *G09G 2310/0275* (2013.01); *G09G 2330/12* (2013.01); *G09G 2380/12* (2013.01)

(58) Field of Classification Search

CPC .. G09G 3/006; G09G 3/3648; G09G 2380/12; G09G 2330/12

USPC ..... 324/414, 500, 537, 760.01

See application file for complete search history.

(56) References Cited

U.S. PATENT DOCUMENTS

| | | | | |
|---|---|---|---|---|
| 5,801,948 A * | 9/1998 | Wood | G05B 23/0264 340/438 |
| 5,959,604 A | 9/1999 | Mosier | |
| 6,816,143 B1 | 11/2004 | Lambert | |
| 7,167,151 B2 | 1/2007 | Yamashita | |
| 8,963,818 B2 * | 2/2015 | Kim | G09G 3/3688 345/87 |

(Continued)

FOREIGN PATENT DOCUMENTS

| | | |
|---|---|---|
| JP | 411042782 A * | 2/1999 |
| KR | 10-2005-0087481 A | 8/2005 |
| KR | 10-2006-0078584 A | 7/2006 |

*Primary Examiner* — Giovanni Astacio-Oquendo

(74) *Attorney, Agent, or Firm* — Standley Law Group LLP

(57) ABSTRACT

An electrical assembly and method for detecting failures in an LCD source driver is disclosed herein. A plurality of active channels are placed on the source driver which communicate electronically with an LCD. At least one dummy channel may be placed on the source driver which is driven with an original signal. A microprocessor may then receive the dummy channel and compare the received dummy channel signal to the original signal. An error message may be transmitted when the received dummy channel signal does not match the original signal. Alternatively, the source driver may be provided with a split active channel which is provided with an original signal that is split into an active split channel and a dummy split channel. While the active split channel is sent to the LCD, the dummy split channel is sent to the microprocessor for comparison with the original signal.

11 Claims, 6 Drawing Sheets

(56) References Cited

U.S. PATENT DOCUMENTS

| | | | | |
|---|---|---|---|---|
| 2005/0128169 | A1* | 6/2005 | Kang | G09G 3/20 345/87 |
| 2005/0128170 | A1* | 6/2005 | Kang | G09G 3/20 345/87 |
| 2005/0276514 | A1 | 12/2005 | Fisher | |
| 2006/0108218 | A1* | 5/2006 | Gephart | A61B 5/145 204/400 |
| 2007/0046680 | A1 | 3/2007 | Hedrick | |
| 2007/0120790 | A1* | 5/2007 | Jeon | G09G 3/006 345/87 |
| 2008/0278644 | A1* | 11/2008 | Fukami | G02F 1/1395 349/37 |
| 2009/0040199 | A1 | 2/2009 | Lee | |
| 2011/0130981 | A1 | 6/2011 | Chaji | |
| 2012/0102255 | A1* | 4/2012 | Moore | G06F 13/4282 710/313 |
| 2014/0043375 | A1* | 2/2014 | Hu | G09G 3/36 345/690 |
| 2017/0060150 | A1* | 3/2017 | Stefanski | G05D 23/27 |
| 2018/0036740 | A1* | 2/2018 | Nelson | B02C 19/18 |
| 2018/0059176 | A1* | 3/2018 | Ding | G01R 1/0433 |

* cited by examiner

LCD SOURCE DRIVER FEEDBACK SYSTEM AND METHOD

CROSS-REFERENCE TO RELATED APPLICATIONS

This application claims priority to U.S. application Ser. No. 61/805,784 filed on Mar. 27, 2013 which is herein incorporated by reference in its entirety.

TECHNICAL FIELD

The disclosed embodiments of the present invention relate to an LCD source driver assembly using dummy feedback channels.

BACKGROUND OF THE ART

LCD assemblies contain a plurality of components that may fail over time. This can be undesirable in many different situations but specifically when the LCD is being used for information purposes within critical applications (such as instrumentation for fixed wing or rotary wing aircraft, ground vehicles, mission control, etc.). At times there are concerns that the LCD display is not being updated accurately due to a failure in the source driver.

SUMMARY OF THE PREFERRED EMBODIMENTS OF THE INVENTION

In an exemplary embodiment, dummy channels may be placed on the source driver and can be driven with known values. The output of these source driver channels can then be compared to the known values to determine if the source driver is functioning properly.

BRIEF DESCRIPTION OF THE DRAWINGS

A better understanding of the disclosed embodiments will be obtained from a reading of the following detailed description and the set of accompanying drawings.

DETAILED DESCRIPTION OF A PREFERRED EMBODIMENT

Figure 1:
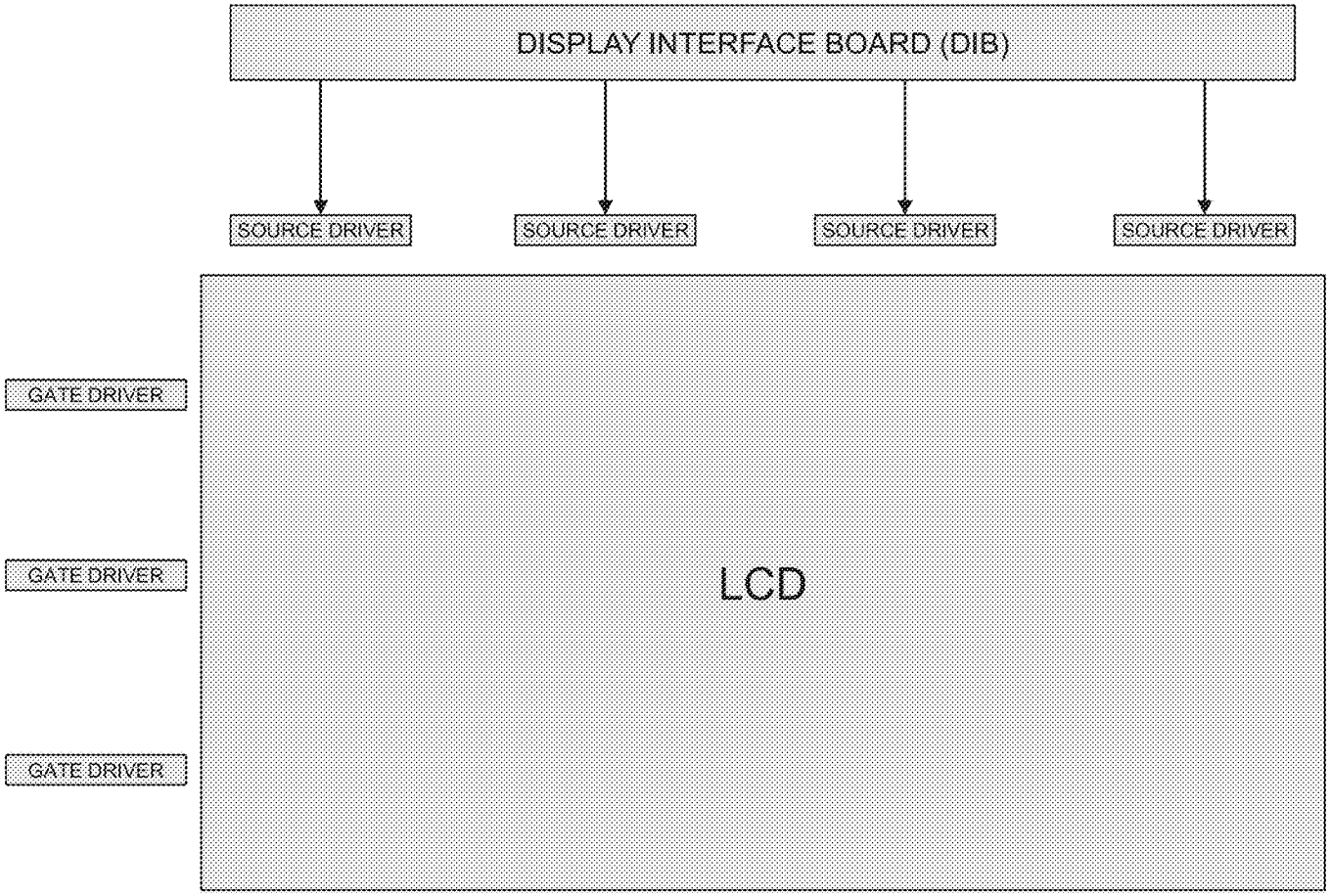
FIG. 1 provides a schematic of a traditional LCD assembly.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 provides a schematic of a traditional LCD assembly. The display interface board (DIB) preferably contains the necessary electronics to control the source and gate drivers.

Figure 2:
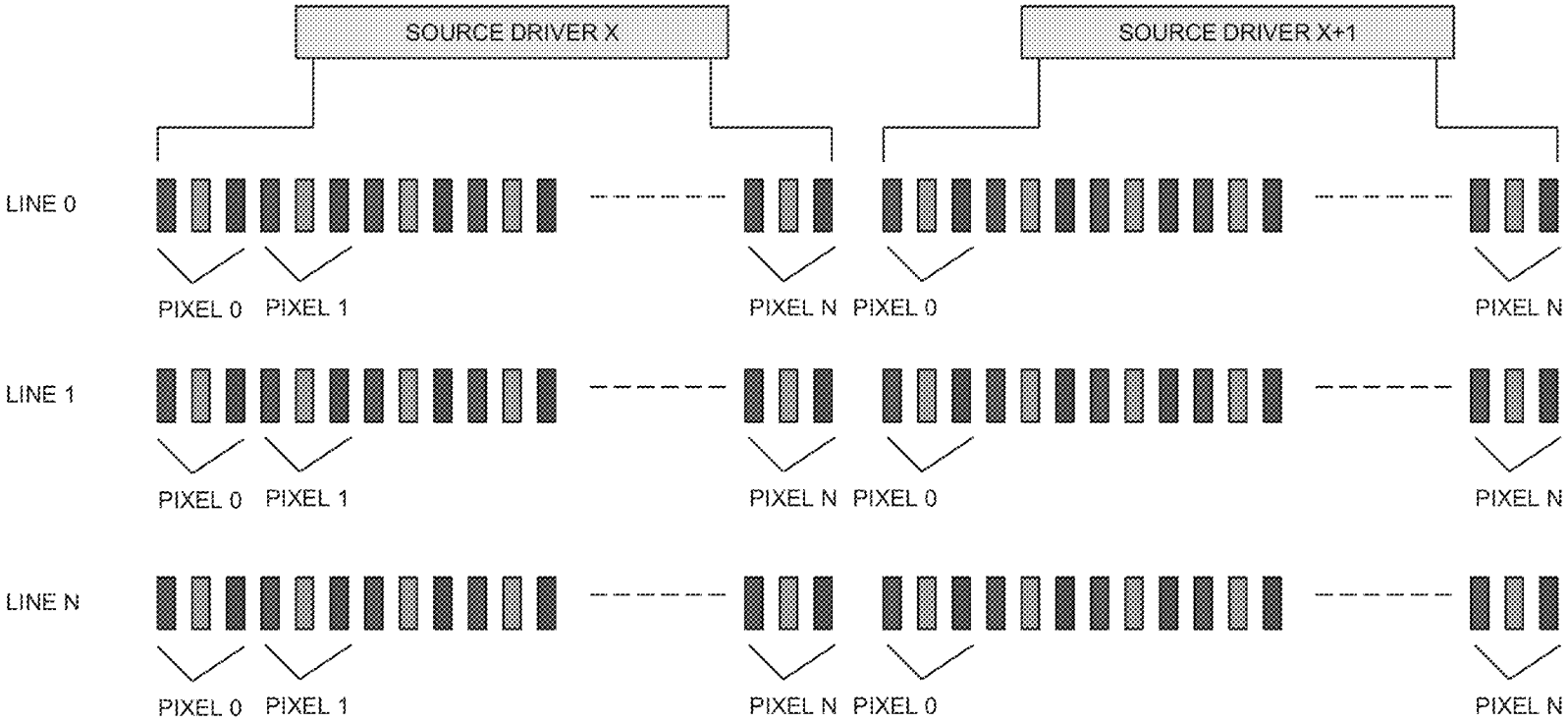
FIG. 2 provides a schematic of a traditional LCD source driver architecture.

FIG. 2 provides a schematic of a traditional LCD source driver architecture. Each source driver typically has 'n' number of channels to drive the red, green, and blue sub-pixels on each line of the LCD. Of course, it is known to use other combinations of sub-pixels in some applications, such as more than one of each red, green, and blue or sometimes an additional sub-pixel color such as yellow. The preferred embodiments herein can be used with any combination and colors for the LCD sub-pixels. The red, green, and blue are the most widely used combination, so this is shown here.

Figure 3:
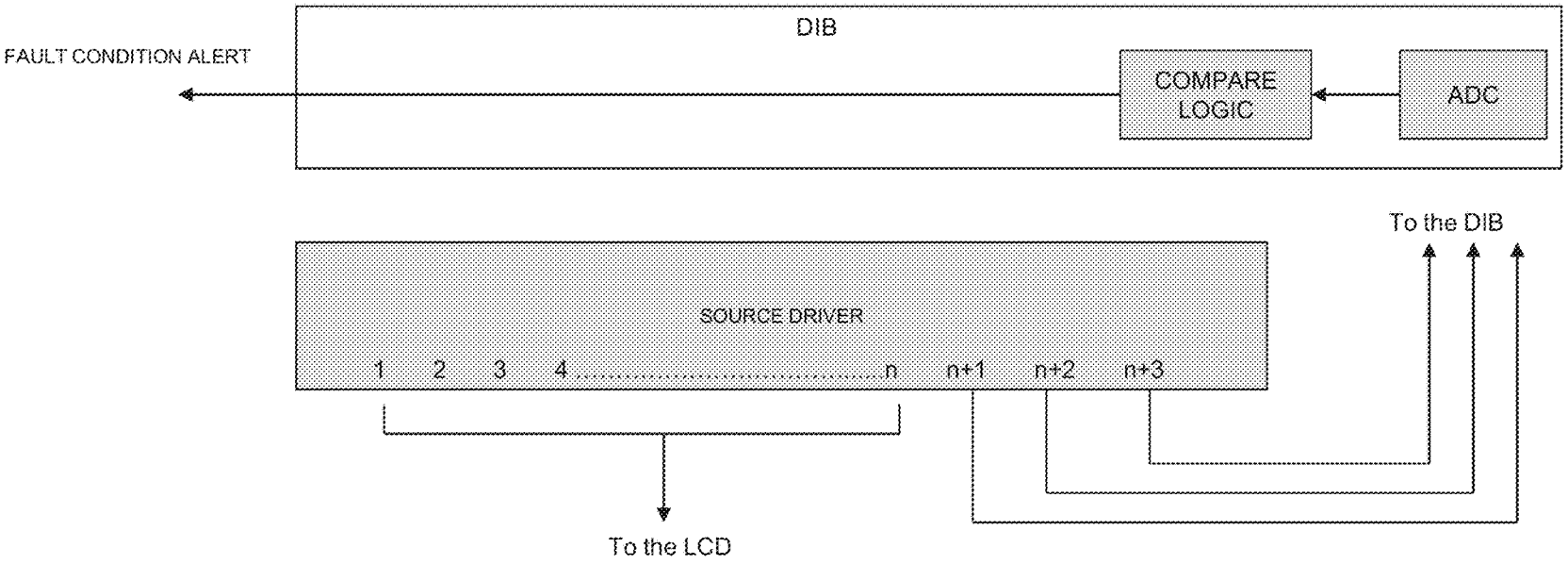
FIG. 3 provides a schematic of an exemplary embodiment of the LCD source driver feedback system.

FIG. 3 provides a schematic of an exemplary embodiment of the LCD source driver feedback system. As an example, assume that the source driver is capable of driving 960 channels or 320 (960/3) pixels (a pixel in this embodiment is comprised of a red, green, and blue sub-pixels). If only 957 channels are used to drive the LCD, then 3 channels may be available for data integrity checking of the source driver. These 3 channels, referred to as "dummy channels" since they are not connected to the LCD, can be routed back to the DIB where they can be digitized (converted from an analog signals to a digital signal) and compared to the known or driven data. It should be noted that although three dummy channels are shown here, three are not required. As few as one or two dummy channels can be used, or alternatively more than three dummy channels could be used. The 'DIB' as used herein refers to a display interface board which is commonly used in LCD applications. Generally speaking, these are printed circuit boards with several electronic components, most notably a microprocessor for operating the logic described throughout this application.

For instance, say the DIB provided a digital value of 255(d) for sub-pixel N+1, digital value of 64(d) for sub-pixel N+2, and a digital value of 128(d) for N+3. The source driver may convert these digital values to a corresponding analog voltage based on gamma and polarity. The analog voltages from N+1, N+2, and N+3 would preferably be routed back to the DIB where they would be digitized and compared against the driven digital values. If the two values match, then one could assume, with a high level of confidence that the source driver is functioning properly. If the two values do not match, then one could assume, with a high level of confidence that the source driver is not functioning properly. If multiple mismatches do occur, then the DIB may alert the control logic upstream that an error condition has been detected. The action taken by the DIB under a fault condition could be any one of many actions, such as but not limited to: driving the LCD black, display text on the LCD indicating a fault condition has occurred, audible warnings, flashing lights or LEDs positioned near the LCD, or any other number of possibilities.

Figure 4:
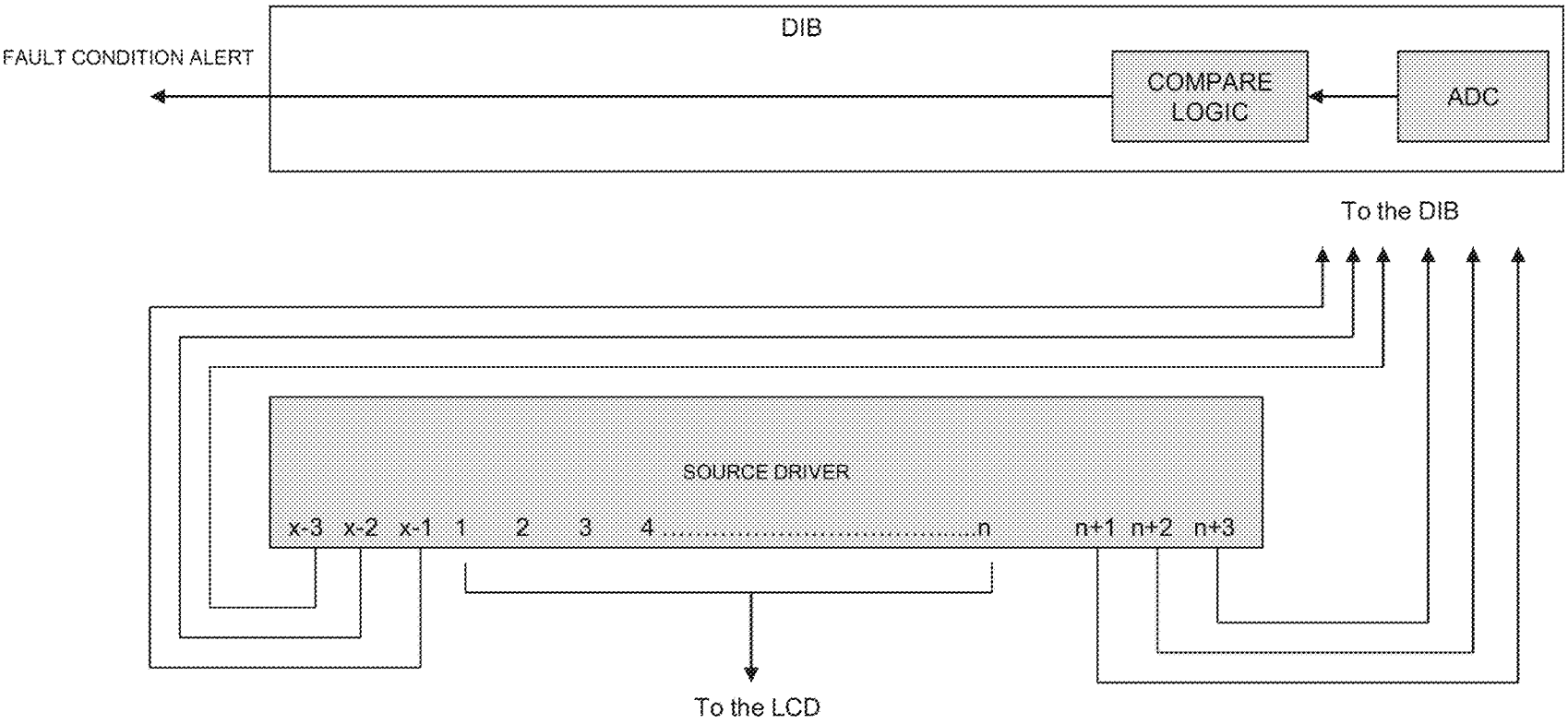
FIG. 4 provides a schematic of an alternative embodiment of the LCD source driver feedback system.

FIG. 4 provides a schematic of an alternative embodiment of the LCD source driver feedback system. There are of course many combinations for connecting the 'dummy' channels out of a source driver and back to the DIB. In this embodiment, the figure shows dummy channels on each end of the source driver. While this embodiment shows three dummy channels on each end of the source driver, there is no requirement that the number of dummy channels on each end of the source driver is equal, as they could be different.

Figure 5:
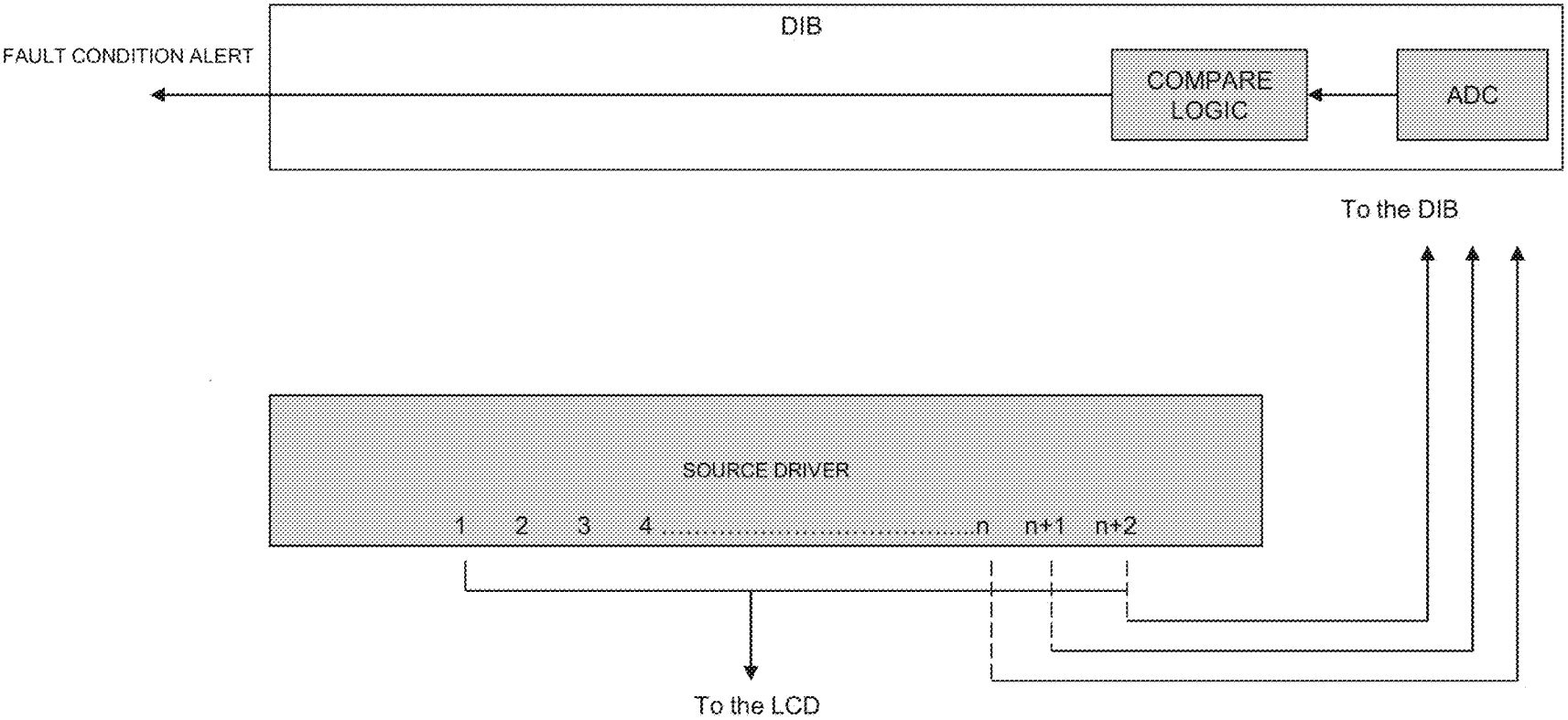
FIG. 5 provides a schematic of an alternative embodiment of the LCD source driver feedback system.

FIG. 5 provides a schematic of an alternative embodiment of the LCD source driver feedback system. This figure illustrates a situation where there may not be any dummy channels available out of the source driver. In this situation, original signals sent to active LCD channels may be split and routed back to a microprocessor on the DIB as a dummy split channel. In this situation, it would be preferable if the original signal sent to the split active channel was a signal for the image to be produced on the LCD. Again, while the embodiment shown uses the last three sub-pixels out of the source driver to perform the integrity check, this is not required. As few as one channel could be used or as many as hundreds of channels could be used. Also, this splitting technique could be used in combination with the designated dummy channel technique shown above in FIGS. 3 and 4.

Figure 6:
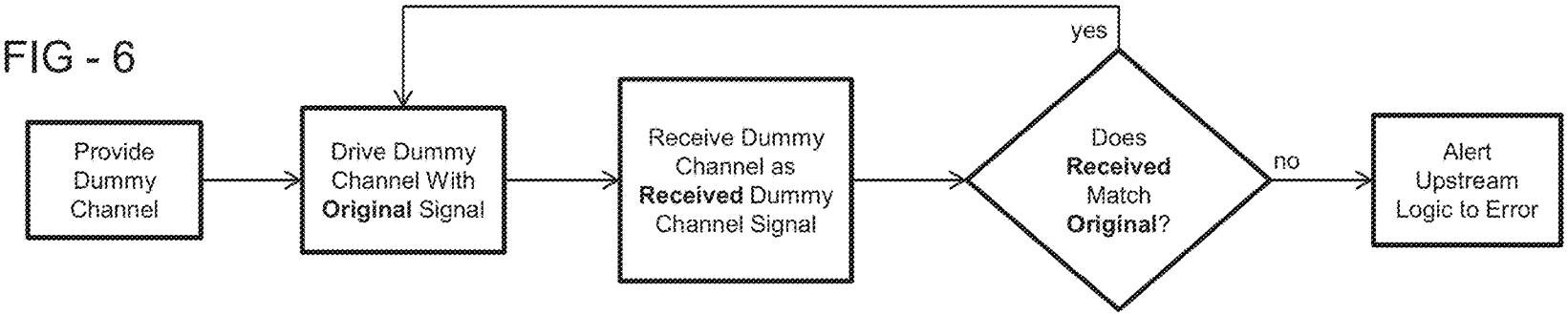
FIG. 6 provides a logical flowchart for one embodiment of the method.

FIG. 6 provides a logical flowchart for one embodiment of the method. Here, at least one dummy channel is initially provided and is driven with an original signal. The resulting signal from the dummy channel is then received as a received dummy channel signal. Here, the DIB or other PCB containing a microprocessor would contain the comparison logic which would preferably compare the received dummy channel signal with the original dummy channel signal. If the two match, the logic returns to drive the dummy channel with another original signal to repeat the process. If the two do not match, an error is sent upstream to notify the user as to an error.

Figure 7:
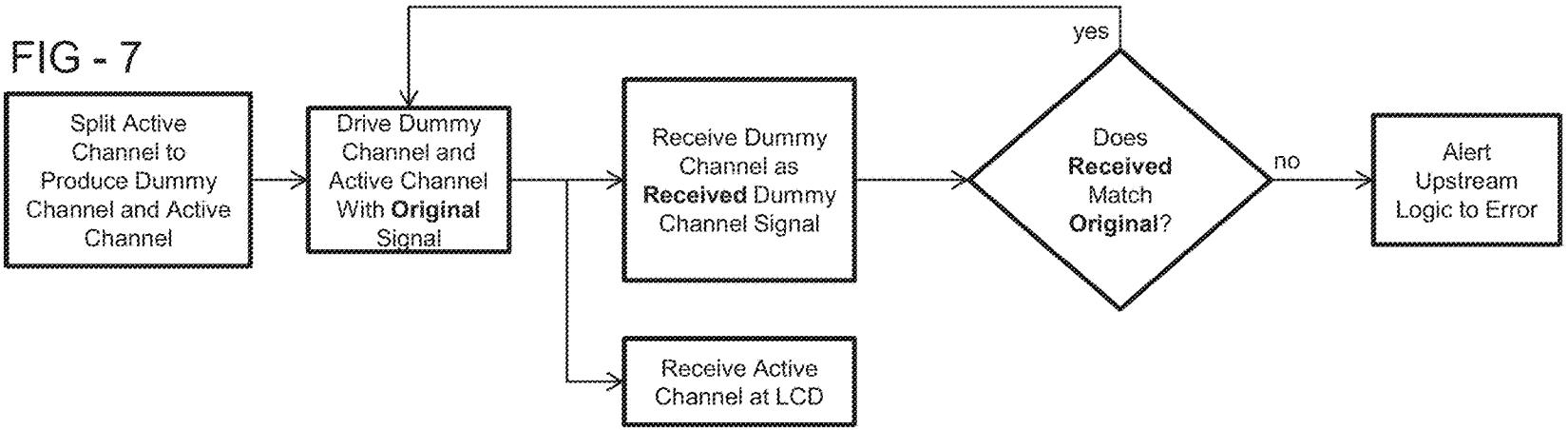
FIG. 7 provides a logical flowchart for another embodiment of the method.

FIG. 7 provides a logical flowchart for another embodiment of the method. In this embodiment, an active channel is initially split to produce a dummy channel and an active channel. Both the dummy channel and the active channel are then driven with the same original signal. The active channel is then sent to the LCD while the dummy channel is received as a received dummy channel signal. Again, this received dummy channel signal is then compared with the original signal to determine if an error has occurred.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A method for detecting a failure in an LCD source driver comprising the steps of:

providing at least one dummy channel in addition to the active channels on the source driver;

driving the dummy channel and all of the active channels to be used, with original signals;

receiving said dummy channel original signal at a microprocessor; and comparing said dummy channel original signal with at least one active channel original signal at the microprocessor.

2. The method of claim 1 further comprising the steps of:
converting the received dummy channel signal from analog to digital before comparing with the original signal.

3. The method of claim 1 further comprising the step of:
alerting upstream logic that a failure has occurred when the received dummy channel signal does not match the original signal.

4. The method of claim 1 further comprising the step of:
splitting an active channel so as to produce a resulting active channel signal and dummy channel signal based on the same original signal.

5. The method of claim 4 further comprising the steps of:
receiving the dummy channel signal and comparing it with the original signal; and
receiving the active channel signal at the LCD.

6. An electrical assembly for detecting failures in an LCD source driver comprising:
a plurality of active channels on the source driver which communicate electronically with an LCD;
a dummy channel on the source driver which is driven with an original signal; and
a microprocessor which receives the dummy channel and compares the received dummy channel signal to the original signal;
wherein the dummy channel is configured to bypass the LCD.

7. The electrical assembly of claim 6 further comprising:
an analog to digital converter which digitizes the received dummy channel signal before comparing it to the original signal.

8. The electrical assembly of claim 6 wherein:
the microprocessor is located on a display interface board.

9. The electrical assembly of claim 6 further comprising:
a second dummy channel on the source driver which is driven with a second original signal; and
wherein the microprocessor additionally receives the second dummy channel and compares the received second dummy channel to the second original signal.

10. The electrical assembly of claim 9 wherein:
the microprocessor is adapted to transmit an error message when either (1) the received dummy channel signal does not match the original signal or (2) the received second dummy channel signal does not match the second original signal.

11. The electrical assembly of claim 6 wherein:
the microprocessor is adapted to transmit an error message when the received dummy channel signal does not match the original signal.

* * * * *